United States Patent [19]

Takase

[11] 3,977,911

[45] Aug. 31, 1976

[54] METHOD FOR CASTING METALLIC MATERIAL WHILE TOUGHENING THE CAST PIECE

[75] Inventor: Seiji Takase, Yokohama, Japan

[73] Assignee: Mitsubishi Jukogyo Kabushiki Kaisha, Tokyo, Japan

[22] Filed: Apr. 24, 1975

[21] Appl. No.: 571,401

[30] Foreign Application Priority Data

May 29, 1974 Japan ..... 49-60624

[52] U.S. Cl. ..... 148/3; 148/131

[51] Int. Cl.[2] ..... C21D 5/00

[58] Field of Search ..... 148/2, 3, 131; 75/123 CB

[56] References Cited

UNITED STATES PATENTS

| | | | |
|---|---|---|---|
| 2,875,109 | 2/1959 | Carter et al. | 148/3 |
| 3,532,561 | 10/1970 | Barto et al. | 148/3 |
| 3,895,968 | 7/1975 | McCulloch et al. | 148/3 |

*Primary Examiner*—W. Stallard

*Attorney, Agent, or Firm*—Cushman, Darby & Cushman

[57] ABSTRACT

An improved method for casting metallic material while toughening the cast piece is described herein. Essentially, the improved method utilizes a part of the thermal energy used for casting to toughen the cast piece by making use of super-plastic phenomena. After metallic material poured into a mould has been solidified, the mould is disintegrated during the period when the temperature of said metallic material is at a raised temperature higher than the temperature of 100°C under a phase transformation point. Under the condition where the thus obtained intermediate product is loaded with a low stress of the order of 1/10 – 1/20 of the yielding point stress of said metallic material, super-plastic phenomena are generated by applying temperature cycles passing over said phase transformation point, and thereby said intermediate product is subjected to toughening treatment.

1 Claim, 2 Drawing Figures

METHOD FOR CASTING METALLIC MATERIAL WHILE TOUGHENING THE CAST PIECE

The present invention relates to a method for performing toughening treatment by generating super-plastic phenomena in a cast piece during a process of casting metallic material.

Heretofore, in a casting process, a heat treatment of a cast piece after it has been cast in a sand mould or in a metallic mould, was the so-called natural annealing treatment such as slowly cooling within a mould to remove a residual casting stress. Accordingly, such prior art methods had a disadvantage that a thermal energy applied to metallic material for melting the same at a high temperature was used only for casting, and after a cast piece had been slowly cooled to a room temperature the cast piece was again heated to perform a heat treatment, so that an excessive thermal energy was required.

Therefore, it is an object of the present invention to provide a method for casting metallic material and simultaneously performing toughening treatment of the cast piece during the casting process, in which the thermal energy required for casting is partly utilized for the toughening treatment of the cast piece to enhance strength and toughness of the cast piece.

According to one feature of the present invention, there is provided a method for casting metallic material while toughening the cast piece characterized in that after the metallic material poured into a mould has been solidified, the mould is disintegrated during the period when the temperature of said metallic material is at a raised temperature higher than the temperature of 100°C under a phase transformation point of said metallic material, and that under the condition where the thus obtained intermediate product is loaded with a low stress of the order of 1/10 – 1/20 of the yielding point stress of said metallic material, super-plastic phenomena are generated by applying temperature cycles passing over said phase transformation point and thereby said intermediate product is subjected to toughening treatment.

Figure 1:
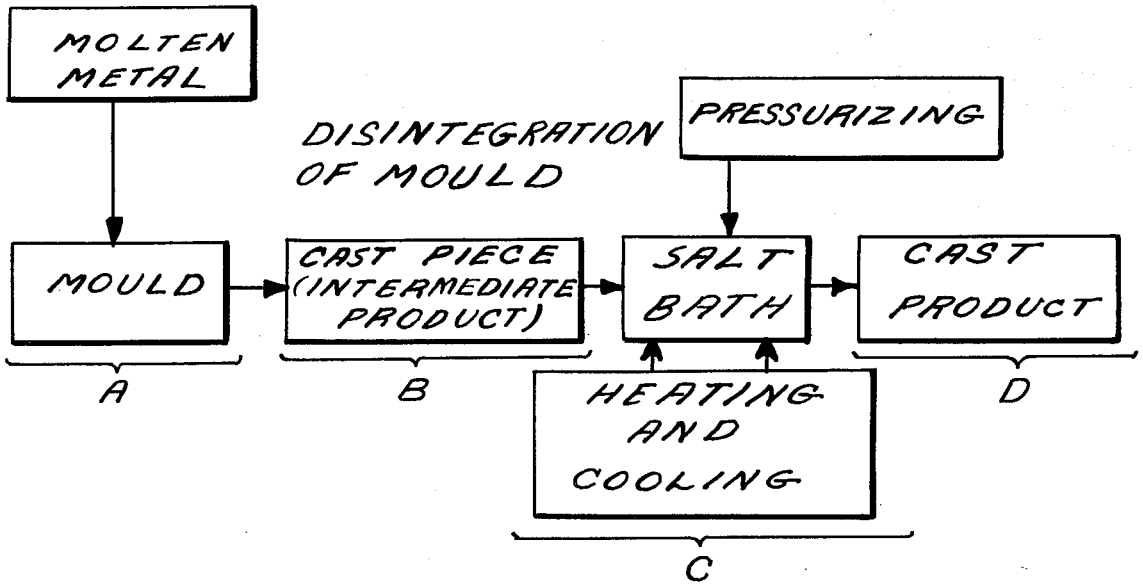
Figure 2:
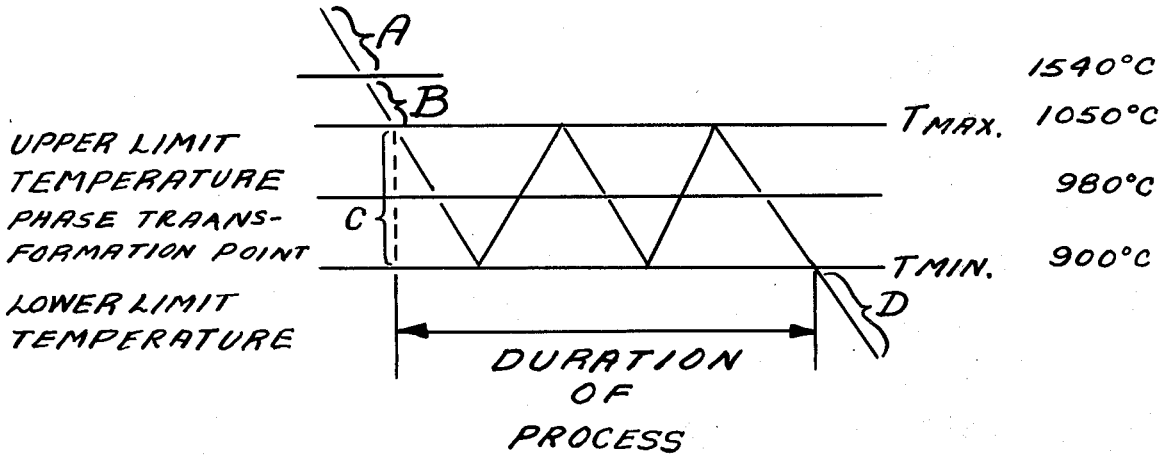

Above-mentioned and other features and objects of this invention will become more apparent by reference to the following description taken in conjunction with the accompanying drawings, in which:

FIG. 1 is a process diagram showing one preferred embodiment of the present invention, and FIG. 2 is a diagram showing the relation of temperature vs. time in the process shown in FIG. 1.

Now the method for casting metallic material while toughening the cast piece according to the present invention will be described in more detail with reference to FIGS. 1 and 2.

As usual, 1.5% carbon cast iron is heated up to 1,540°C to be molten, and the molten metal is poured into a mould as shown in FIG. 1. This process is a casting process A.

The temperature of the molten metal is gradually lowered and is solidified naturally, and when the temperature has reached the vicinity of about 1,050°C, the mould is disintegrated to take out a cast piece (intermediate product), which is then immersed in a salt bath. The above-mentioned process is an intermediate product take-out process B.

The salt bath is provided with a pressurizing device, so that the intermediate product immersed in the salt bath can be applied with a pressure. While applying a stress of about 2kg/mm$^2$ to the intermediate product within the salt bath, the intermediate product is subjected to heating and cooling temperature cycles (at a rate of 4 – 5 cycles per minute) passing over a phase transformation point (980°C) in a temperature range including the phase transformation point (the range covering about 100°C above and under the phase transformation point with an upper limit of 1,050°C and a lower limit of 900°C). The above process is a super-plastic treatment process C.

Then the intermediate product is taken out of the salt bath and cooled naturally to obtain a desired cast product. This process is a cast product take-out process D.

According to the aforementioned embodiment, since the first cycle of the temperature cycles starts from cooling, the cast piece is cooled from its molten state on an equilibrium phase diagram, and the heating and melting temperature of the metallic material is chosen at a temperature higher than the temperature crossing over a solid phase line, for example, at 1,540°C. In the second and subsequent cycles, since the heating of the intermediate product does not rely upon direct heating, the upper limit temperature of the temperature cycle is set at a temperature higher than the phase transformation point (at 1,050°C). By applying the above-mentioned temperature cycles to the intermediate product to generate super-plastic phenomena therein, micro-fining of crystal grains as well as equalization of metallurgical structure would occur in the intermediate product, and as a result of the micro-fining of crystal grains and the equalization of metallurgical structure, a cast piece having a sufficient strength can be obtained.

In the above-described embodiment, the upper and lower limits of the temperature range in the temperature cycle were selected at about ±100°C with respect to the transformation point, and the frequency of the temperature cycle was selected at 4 – 5 cycles per minute. The reasons why such specific values were selected, are because the variation of the transformation point caused by the change of the heating and cooling speeds as well as the time period required between the commencement and termination of the transformation were taken into consideration. Although the applied stress is set at 2 kg/mm$^2$, it could be selected normally at about 1/10 to 1/20 of the yielding point (the maximum durable stress) of the metallic material.

Upon practicing the present invention, the conditions for the temperature cycle passing through the transformation point up and down so as to generate super-plastic phenomena such as, for example, temperature range, frequency, applied stress, etc., can be selected at appropriate values depending upon the properties and shape of the material to be treated.

While the present invention has been described above with respect to an embodiment employing cast iron as the metallic material, the invention can be equally applied to cast steel, non-ferrous alloys, etc. For instance, in the case of non-ferrous alloy of A1BC, a phase transformation point ($\alpha + \delta \rightarrow \beta$ of 570°C and $\beta$ solubility of 850° – 570°C) is utilized, and if similar temperature cycles are applied to the metallic material with the upper and lower limit temperatures of the heating and cooling temperature cycles set at 880° – 900°C and 500° – 520°C, respectively, then a desired cast piece can be obtained.

According to the present invention, since the toughening treatment is applied to an intermediate product under a super-plastic state, a higher strength than that of the cast pieces in the prior art can be obtained, and further, the casting and toughening of the cast product can be practiced in one process. In addition, with regard to the cast material, the same effects can be obtained in the case of ferrous material and non-ferrous metallic material (having a transformation point), too. Furthermore, the casting crack which often occurred in the prior art method, can be prevented according to the present invention, and a cast piece which has already had a casting defect can be remedied by introducing the same material into the defect portion (Either a wedge-shaped solid body may be inserted or powders may be applied.).

In summary, according to the present invention, after the metallic material poured into a mould has been solidified, the mould is disintegrated during the period when the temperature of said metallic material is at a raised temperature higher than the temperature of 100°C under a phase transformation point of said metallic material, then under the condition where the thus obtained intermediate product is loaded with a low stress of the order of 1/10 – 1/20 of the yielding point stress of said metallic material, super-plastic phenomena are generated by applying temperature cycles passing over said transformation point and thereby said intermediate product is subjected to toughening treatment, and thus a tough cast piece can be easily obtained. Therefore, the present invention is industrially useful.

Since many changes could be made in the above method and many apparently widely different embodiments of this invention could be made without departing from the scope thereof, it is intended that all matter contained in the above description and shown in the accompanying drawings shall be interpreted as illustrative and not in a limiting sense.

What is claimed is:

1. A method for casting metallic material while toughening the cast piece, characterized in that after the metallic material poured into a mould has been solidified, the mould is disintegrated during the period when the temperature of said metallic material is at a raised temperature higher than the temperature of 100°C, under a phase transformation point of said metallic material, and that under the condition where the thus obtained intermediate product is loaded with a low stress of the order of 1/10 – 1/20 of the yielding point stress of said metallic material, super-plastic phenomena are generated by applying temperature cycles passing over said phase transformation point and thereby said intermediate product is subjected to toughening treatment.

* * * * *